US008123492B2

(12) United States Patent
Williamson

(10) Patent No.: US 8,123,492 B2
(45) Date of Patent: Feb. 28, 2012

(54) SPEED-RELATED CONTROL MECHANISM FOR A PUMP AND CONTROL METHOD

(75) Inventor: Matthew Williamson, Richmond Hill (CA)

(73) Assignee: Magna Powertrain Inc., Concord (CA)

( * ) Notice: Subject to any disclaimer, the term of this patent is extended or adjusted under 35 U.S.C. 154(b) by 1377 days.

(21) Appl. No.: 11/575,617

(22) PCT Filed: Sep. 20, 2005

(86) PCT No.: PCT/CA2005/001424

§ 371 (c)(1), (2), (4) Date: Mar. 20, 2007

(87) PCT Pub. No.: WO2006/032131

PCT Pub. Date: Mar. 30, 2006

(65) Prior Publication Data

US 2008/0063537 A1 Mar. 13, 2008

(51) Int. Cl.
*F04B 49/00* (2006.01)
*F04B 1/06* (2006.01)

(52) U.S. Cl. ..... 417/216; 417/218; 417/221

(58) Field of Classification Search ..... 417/38, 417/213, 221, 274, 310, 375, 216, 218, 219, 417/220; 418/30

See application file for complete search history.

(56) References Cited

U.S. PATENT DOCUMENTS 3,771,921 A * 11/1973 Rohde et al. ..... 417/12
3,813,189 A * 5/1974 Tompkins ..... 417/220
3,924,969 A * 12/1975 Rometsch et al. ..... 417/218
4,067,664 A * 1/1978 Robeller ..... 417/218
4,347,048 A * 8/1982 Kawabata et al. ..... 417/310
4,496,288 A * 1/1985 Nakamura et al. ..... 417/213
4,496,290 A 1/1985 Nonnenmacher
4,509,902 A * 4/1985 Knodel et al. ..... 417/216
4,601,641 A * 7/1986 Kuroyanagi et al. ..... 417/220
4,711,616 A * 12/1987 Tsukahara et al. ..... 417/216
5,141,418 A * 8/1992 Ohtaki et al. ..... 418/26
5,183,392 A * 2/1993 Hansen ..... 417/203
5,980,215 A 11/1999 Robeller et al.
6,042,343 A * 3/2000 Semba et al. ..... 417/220
6,352,415 B1 * 3/2002 Uchino ..... 417/220
6,478,559 B2 * 11/2002 Bishop et al. ..... 418/133
6,524,076 B2 * 2/2003 Konishi ..... 417/213
6,579,070 B1 * 6/2003 Birkenmaier et al. ..... 417/216
6,616,419 B2 * 9/2003 Watanabe et al. ..... 417/220
6,790,013 B2 * 9/2004 Hunter et al. ..... 417/220
2003/0059312 A1 * 3/2003 Konishi et al. ..... 417/213
2005/0047930 A1 * 3/2005 Schmid ..... 417/274
2005/0047938 A1 3/2005 Konishi et al.

* cited by examiner

*Primary Examiner* — Devon C Kramer
*Assistant Examiner* — Alexander Comley
(74) *Attorney, Agent, or Firm* — Harness, Dickey & Pierce

(57) ABSTRACT

A pump system includes a fixed or variable capacity pump and a speed-related control mechanism to alter the capacity of a variable capacity pump or to alter the relief pressure of a fixed capacity pump in response to changes in the operating speed of the pump. A pressure generator comprising a volume of working fluid is rotated at a speed related to the operating speed of the pump and creates a forced vortex in the working fluid. The pressure induced in the working fluid of the forced vortex is used as a speed related control to alter the discharge pressure of the pump as desired.

9 Claims, 5 Drawing Sheets

SPEED-RELATED CONTROL MECHANISM FOR A PUMP AND CONTROL METHOD

FIELD OF THE INVENTION

The present invention relates to fixed or variable capacity pumps. More specifically, the present invention relates to a speed-related control mechanism to control the output of a fixed or variable capacity pump.

BACKGROUND OF THE INVENTION

Pumps for incompressible fluids, such as oil, are often gear, vane or piston pumps. In environments such as engine lubricating systems, gear pumps are often employed as they are reliable and relatively inexpensive to manufacture.

Gear pumps suffer from a disadvantage in that they are a constant displacement volume (capacity) pump (i.e.—they pump substantially the same volume of fluid for each revolution of the pump and thus deliver more fluid at higher operating speeds than at lower speeds). In environments such as automotive engine lubrication systems, wherein the pump speed will change while the required amount of fluid to be provided by the pump will remain substantially constant, the pump capacity is sized to provide the necessary volume of fluid at the expected lower operating speeds and thus, at higher operating speeds, the gear pump will oversupply the fluid.

To control the oversupply, and the resulting over pressure which would otherwise damage engine components, gear pumps in such environments are typically provided with a pressure relief valve which allows the undesired portion of the oversupplied fluid to return to a sump, tank or back to the inlet of the pump so that only the desired volume of fluid is supplied to the engine.

While equipping gear pumps with such pressure relief valves does manage the problems of oversupply at higher operating speeds, there are disadvantages with such systems. For example, the pump still consumes input energy to pump the oversupply of fluid, even though the pressure relief valve prevents delivery of the undesired portion of the oversupplied fluid, and thus the pump consumes more engine power than is necessary.

An alternative to gear pumps, in such environments, is the variable capacity vane pump. Such pumps include a moveable ring known as a slide ring, which allows the eccentricity of the pump to be altered to vary the capacity of the pump. Typically a control piston, connected to the slide ring, or alternatively, a pressurized chamber formed between the slide ring and the pump housing, is supplied with pressurized oil, directly or indirectly, from the output of the pump and, when the force created by the pressure of the supplied oil acting either on the control piston or directly on the slide ring is sufficient to overcome the force of a return spring, the slide ring is moved to reduce the capacity of the pump and thus lower the volume of the pumped oil to a desired level. If the supplied pressurized oil is at a pressure less than the desired level, then the force generated at the control piston or on the slide ring is less than that generated by the return spring and the return spring will move the slide ring to increase the capacity of the pump. In this manner, the output volume of the pump can be adjusted to maintain a selected value of pressure.

A disadvantage of both fixed and variable capacity pumps when controlled in the ways previously described is that, when operating above a threshold value of speed, the control pressure is constant according to the balance of forces between the spring and the pressurized area of the piston or slide ring. The threshold speed is the speed below which the pressure is insufficient to move the slide ring or open the relief valve. The value chosen for the control pressure depends on the worst case operating condition, which is typically at maximum speed, whereas the engine is likely to spend most operational time at lower speeds, when a lower control pressure would be satisfactory.

It is desirable in these circumstances to vary the output pressure of these pumps relative to the speed of the engine. Effective pressure control of the pump, based at least partially on the operating speed of the engine, can result in an improvement in engine efficiency and/or fuel consumption.

While such speed-related control can be achieved by a combination of electronic speed sensors, computer controllers and solenoid actuators, to date no effective and reliable mechanical means to accomplish such speed-related control has been available.

SUMMARY OF THE INVENTION

It is an object of the present invention to provide a novel system and method of controlling the pressure of a fixed or variable capacity pump which obviates or mitigates at least one disadvantage of the prior art.

According to a first aspect of the present invention, there is provided a speed-related control mechanism for a fixed or variable capacity pump having a regulating mechanism for regulating output pressure; and a pressure generator to supply pressurized fluid to the regulating mechanism, the pressure of the supplied fluid being proportional to the operating speed of the pump.

Preferably, the pressure generator comprises: a disc defining an interior volume containing a fluid; at least one inlet port to supply working fluid to the volume; at least one outlet port to supply working fluid from the disc to the chamber of the pump, the disc being rotated at a speed related to the operating speed of the pump to create a forced vortex in the working fluid to pressurize the working fluid at the at least one outlet port proportionally to the square of the rotational speed of the disc.

According to a second aspect of the present invention, there is provided a variable capacity pump system, comprising: a variable capacity pump having a moveable capacity adjusting element; an equilibrium pressure control comprising a first chamber connected to the moveable capacity adjusting element and supplied with pressurized fluid from the outlet of the pump and a return spring connected to the moveable capacity adjusting element and acting against the force generated by pressurized fluid in the first chamber; and a speed-related control comprising: a pressure generator to supply pressurized fluid, the pressure of the supplied fluid being proportional to the operating speed of the pump; and a second chamber connected to the moveable capacity adjusting element and acting with the return spring, the second chamber being supplied with pressurized fluid from the pressure generator.

According to a third aspect of the present invention, there is provided a fixed capacity pump system, comprising: a fixed capacity pump; an equilibrium pressure control comprising a valve plunger whose first end is supplied with pressurized fluid from the outlet of the pump, a valve bore with an opening leading to a low pressure space such as the pump inlet, the valve plunger being disposed in the valve bore such that the position of the valve plunger determines whether the opening is blocked or connected to the pump outlet, a return spring acting against the valve plunger such as to close off the opening; and a speed-related control comprising: a pressure generator to supply pressurized fluid, the pressure of the supplied fluid being proportional to the operating speed of the pump; the pressurized fluid being supplied to a second end of the valve plunger, such that the force generated acts with the return spring to close off the opening.

According to a fourth aspect of the present invention, there is provided a pressure generator to provide a working fluid pressurized whose pressure is proportional to the square of the speed at which a device is rotated, comprising: a disc defining a volume to contain a fluid; at least one inlet port to supply working fluid to the volume; at least one outlet port to supply working fluid from the disc, the disc being rotated at a speed related to the speed at which the device is rotating to create a forced vortex in the working fluid to pressurize the working fluid at the at least one outlet port proportionally to the rotational speed of the device.

According to yet another aspect of the present invention, there is provided a method for the speed responsive control of a variable capacity pump, comprising the steps of: (i) providing a piston supplied with working fluid from the output of the pump, the piston moving a capacity altering member of the pump to decrease the capacity of the pump; (ii) providing a return spring acting against the piston to move the capacity altering member of the pump to increase the capacity of the pump; and (iii) providing a second piston supplied with working fluid from a pressure generator, the piston acting with the return spring to move the capacity altering member of the pump to increase the capacity of the pump, the pressure generator pressurizing the working fluid proportionally to the operating speed of the pump.

According to yet another aspect of the present invention, there is provided a method for the speed responsive control of a fixed capacity pump, comprising the steps of: (i) providing a valve plunger whose first end is supplied with working fluid from the outlet of the pump, which when allowed to move past an opening in the valve bore, allows fluid to pass from the pump outlet to a low pressure space such as the pump inlet and thereby reduces the outlet flow of the pump system; (ii) providing a return spring acting against the valve plunger in a direction opposed to that of the force generated by the working fluid pressure thereby tending to close the valve; and (iii) providing a chamber at the second end of the valve plunger supplied with working fluid from a pressure generator, the force thereby generated acting with the return spring and also tending to close the valve, the pressure generator pressurizing the working fluid proportionally to the operating speed of the pump.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
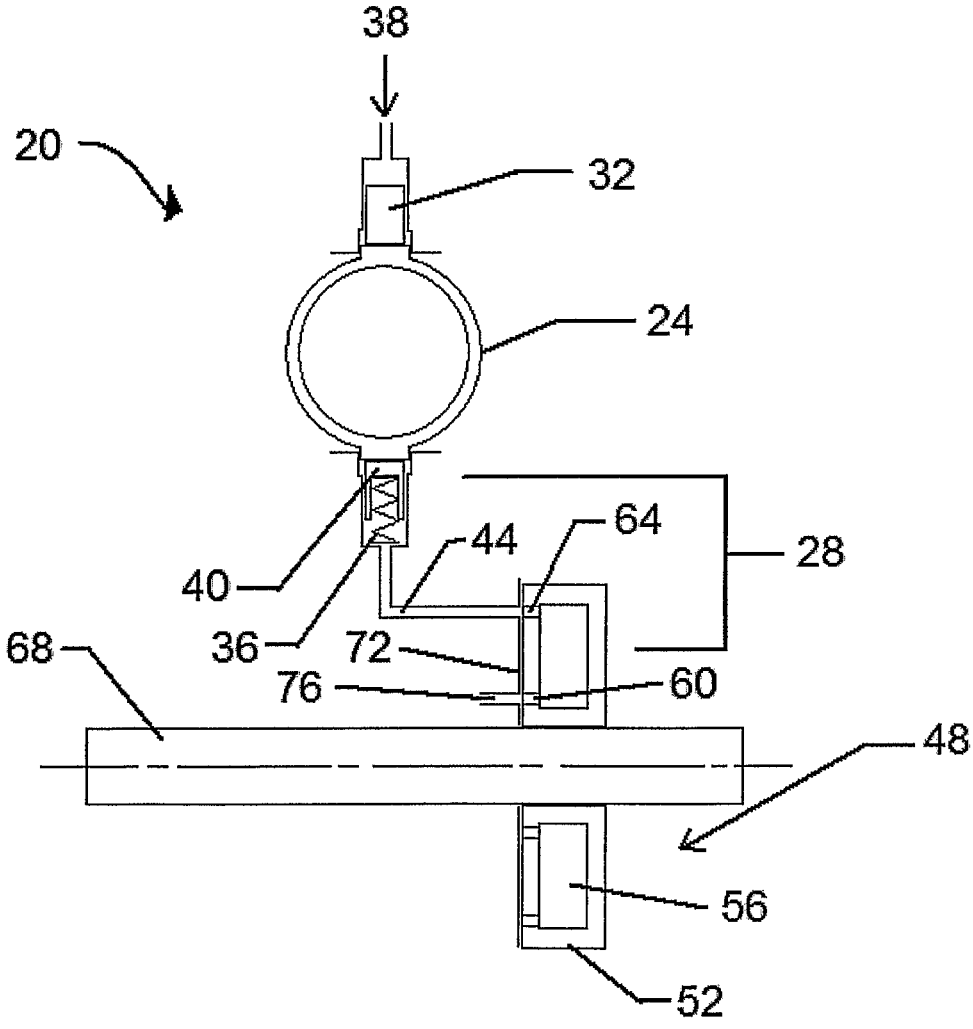
FIG. 1 shows a schematic representation of a system including variable capacity pump and a speed-related control mechanism in accordance with the present invention.

A pump system including a speed-related control mechanism and variable capacity pump in accordance with an embodiment of the present invention is indicated generally at 20 in FIG. 1. System 20 includes a capacity adjusting mechanism 24, which in this embodiment is the moveable ring of the vane pump, and a speed-related control mechanism 28 for operating the capacity adjusting mechanism 24.

While the following discussion relates to a variable capacity vane pump, the present invention can be employed with other fixed or variable capacity pumps as will be apparent to those of skill in the art. Variable capacity vane pumps are typically provided with a pressure control piston 32 and a return spring 36 to provide pressure-relief type control. The working fluid 38 from the outlet side of the pump, such as oil from a reservoir or gallery in an engine, is supplied to pressure control piston 32 and, when the pressure is sufficient to create enough force on pressure control piston 32 to overcome the force of return spring 36, the pressure control piston will move the pump ring to reduce the capacity of the pump. If the pressure supplied to pressure control piston 32 is insufficient to overcome the force of return spring 36, then return spring 36 moves the pump ring to increase the capacity of the pump. These pumps typically reach equilibrium at a constant value of pressure, provided that the pump ring is not abutting any limit stops, or the like, and the equilibrium pressure is determined by the piston area that the pressurized working fluid acts against and the return spring force.

In addition to the above-mentioned equilibrium pressure control mechanism, pump system 20 further includes speed-related control mechanism 28 which comprises a control piston 40, a control pressure supply 44 and a pressure generator 48. Control piston 40 is connected to control pressure supply 44 and, as the pressure of control pressure supply 44 increases, piston 40 applies force to adjustment mechanism 24 in addition to that of return spring 36 which tends to increase the capacity of the variable capacity pump. The increased capacity thus achieved increases the flow volume delivered by the pump with a commensurate increase in the pressure of the flow through the device supplied with the flow.

Control pressure supply 44 is not supplied with working fluid from the output side of the pump but is instead supplied with working fluid from pressure generator 48 which, as described below, varies the pressure of the supplied fluid with the square of the operating speed of the pump. Therefore, a pump system in accordance with the present invention reaches a steady state equilibrium at a range of discharge volumes (and associated pressures) which increase with rotational speed of the pump.

Figure 2:
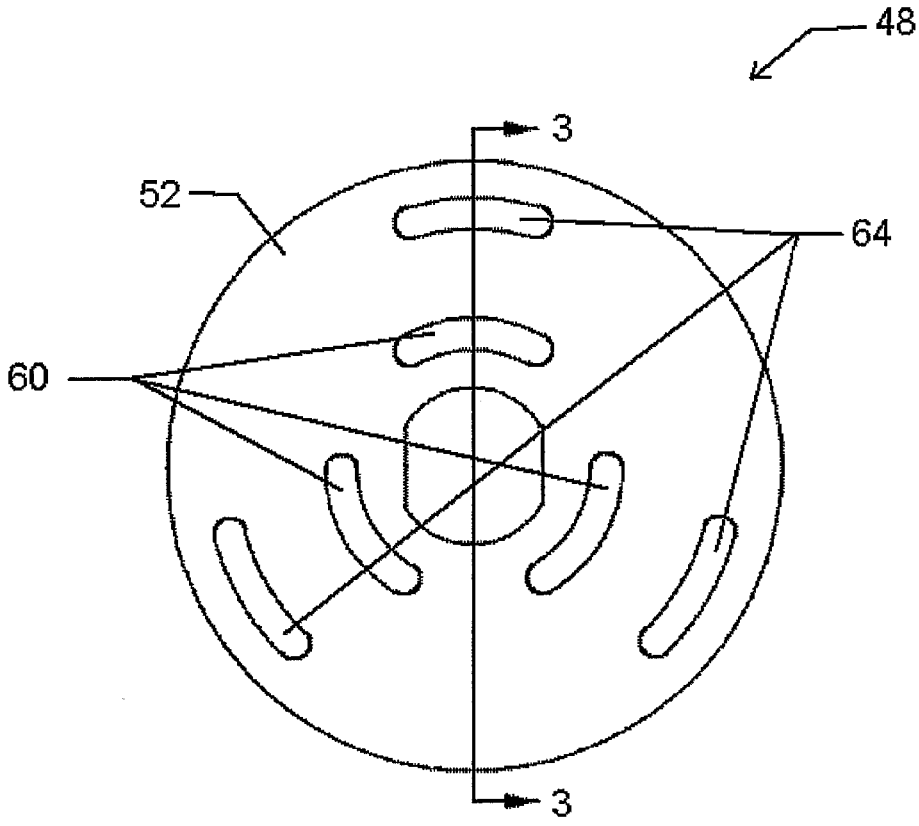
FIG. 2 shows a front view of the body of a pressure generator utilized in the system of FIG. 1.
Figure 3:
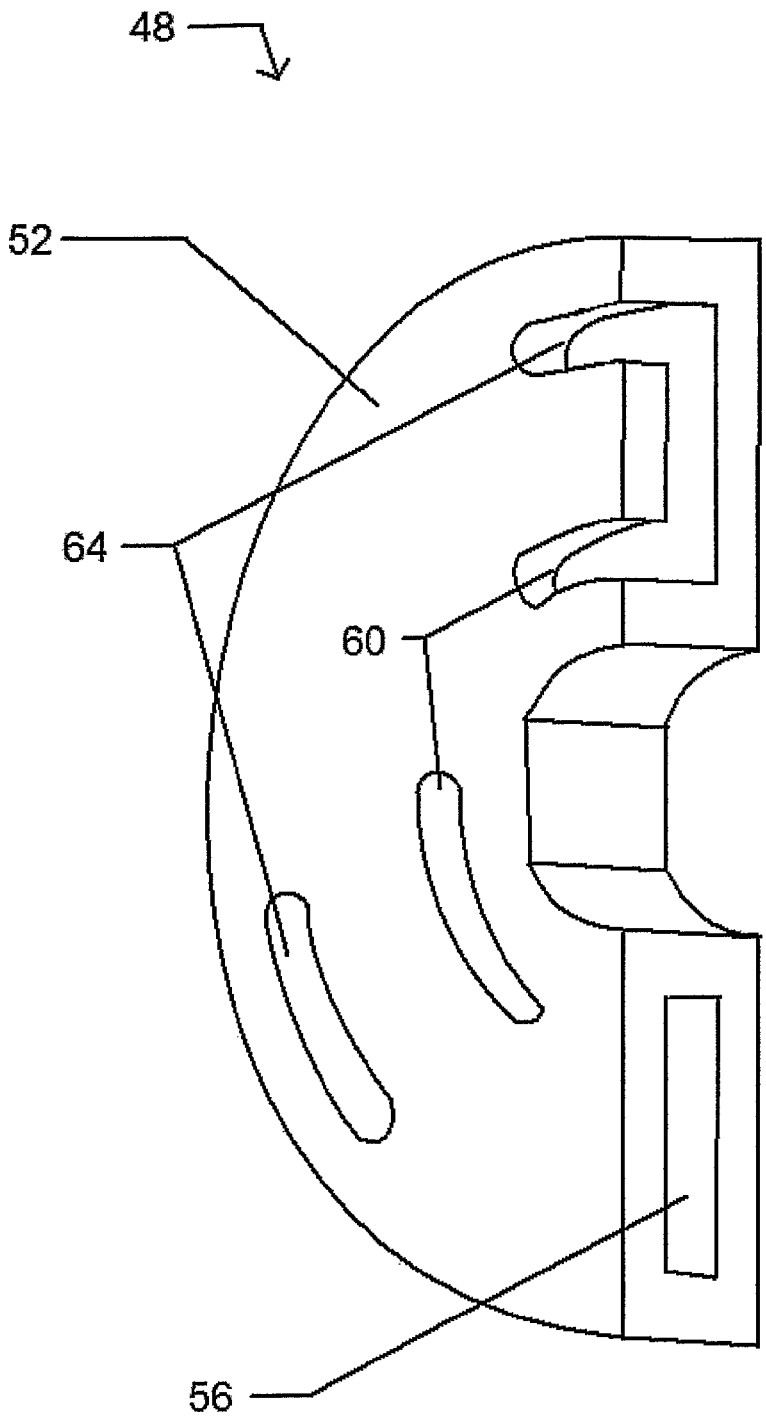
FIG. 3 shows a perspective view of a section, taken through line 3-3, of the body of FIG. 2.

As best seen in FIGS. 2 and 3, pressure generator 48 comprises a disc 52 which defines an enclosed interior annular volume 56. At least one inlet port 60 and one outlet port 64, and in the illustrated embodiment a set of three inlet ports 60 and a set of three outlet ports 64, extend into disc 52 to annular volume 56 and allow working fluid to enter and exit volume 56. As illustrated, outlet ports 64 are adjacent to the outer periphery of disc 52 while inlet ports 60 are adjacent the axis of rotation of disc 52.

As shown in FIG. 1, disc 52 is mounted on, and rotates with, drive shaft 68 which drives the impeller of the vane pump. A manifold 72 connects a working fluid supply 76 with inlet ports 60 and connects outlet ports 64 to control pressure supply 44. Fluid supply 76 is connected to the inlet of the variable capacity pump and supplies fluid at zero gauge pressure to volume 56.

As will be apparent to those of skill in the art, as disc 52 rotates with drive shaft 68, a forced vortex is created in volume 56, i.e.—the volume of fluid within volume 56 rotates with disc 52 with little or no relative movement of the particles of the fluid. In such a forced vortex, the pressure of the fluid within volume 56 increases with the radial distance of the fluid from the axis of rotation. Thus, the pressure of the working fluid at inlet ports 60 will be less than the pressure of the fluid at outlet ports 64 and the difference between the pressures is dependent upon the square of the rotational speed of drive shaft 68. Specifically, the difference in pressure of the fluid between outlet ports 64, and inlet ports 60, is given by $$p_o - p_i = \frac{\rho \cdot \omega^2}{2} \cdot (r_o^2 - r_i^2)$$

where $p_o$ is the pressure at the outlet ports 64 in Pascals, $p_i$ is the pressure at the inlet ports 60 in Pascals, ρ is the density of the fluid in kg/m$^3$, ω is the speed of drive shaft 68 in rad/sec, $r_i$ is the distance in meters of the inlet ports 60 from the rotational center of disc 52 and $r_o$ is the distance in meters of the outlet ports 64 from the rotational center of disc 52.

As will now be apparent, the fluid in volume 56 is thus pressurized proportionally to the square of the speed of drive shaft 68. Thus, in this particular embodiment, control pressure supply 44 varies with the square of the speed of drive shaft 68 and speed-related control mechanism 28 operates capacity adjusting mechanism 24 responsive to the square of the speed of drive shaft 68.

As the speed of the engine, and thus drive shaft 68, increases, the pressure of control pressure supply 44 on control piston 40 is increased, adding to the force of return spring 36 and speed-related control mechanism 28 moves capacity adjusting mechanism 24 to increase the capacity of the pump. Conversely, as the speed of the engine, and thus drive shaft 68, decreases, the pressure of control pressure supply 44 on piston 40 is decreased, decreasing the total of the force exerted by piston 40 and return spring 36 on capacity adjusting mechanism 24, so that capacity adjusting mechanism 24 moves to decrease the capacity of the pump. Thus, speed-related control mechanism 28 provides pump system 20 with a speed responsive control of the capacity of the pump.

Figure 4:
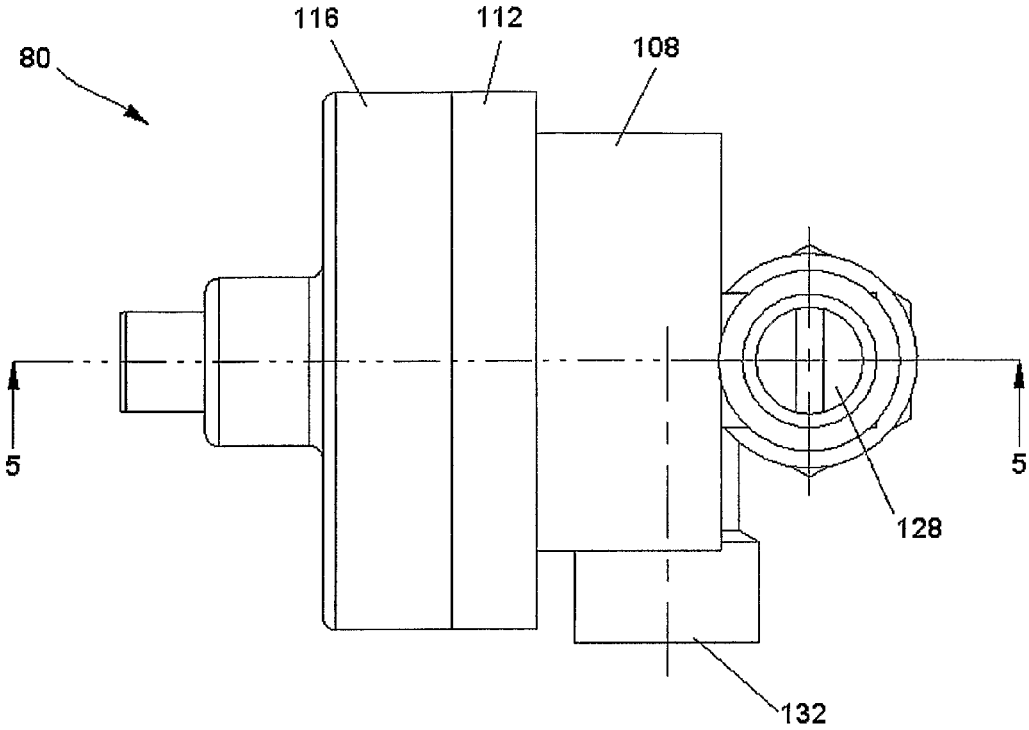
FIG. 4 shows a front view of a system including a fixed capacity pump and a speed related control mechanism in accordance with the present invention.
Figure 5:
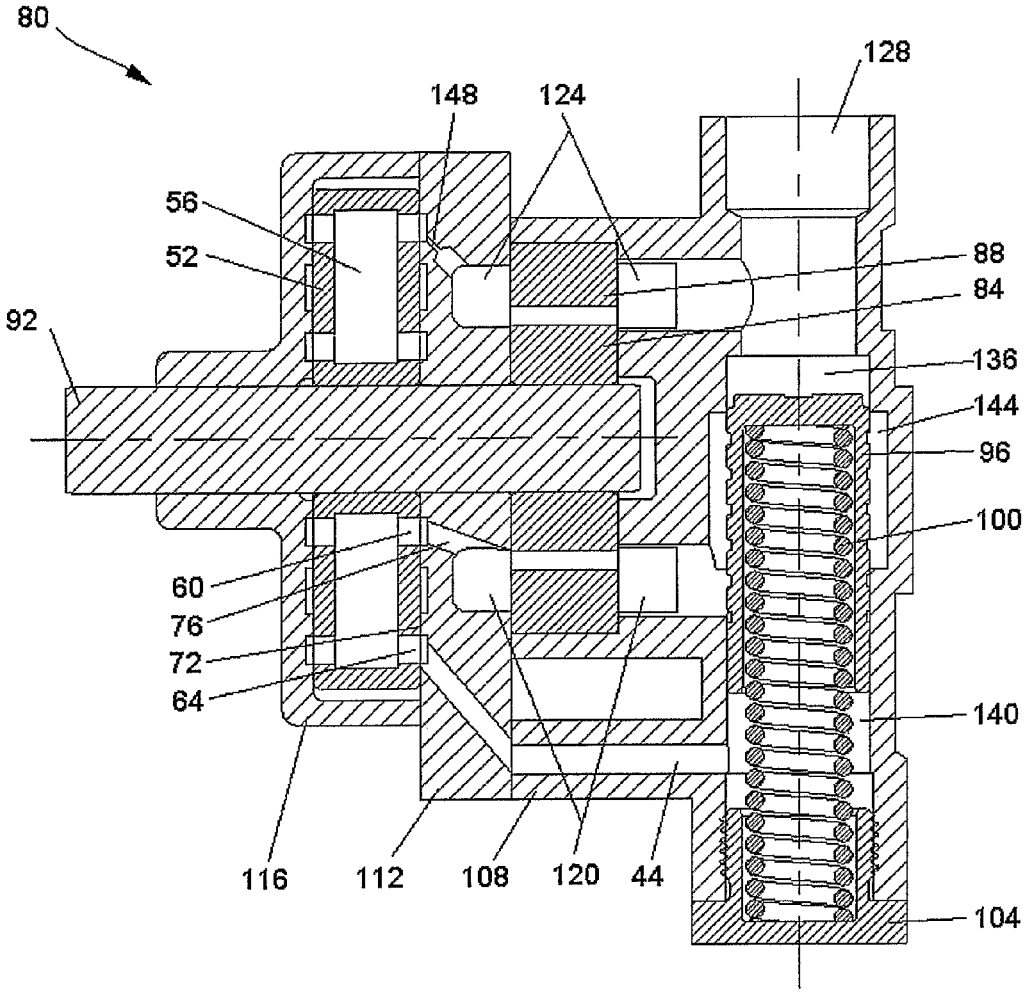
FIG. 5 shows a section view taken through the line 5-5, of the system of FIG. 4.

A pump system including a fixed displacement pump and a speed related pressure control mechanism is generally indicated at 80 in FIGS. 4 and 5. The fixed displacement pump shown in this embodiment is a gear pump and comprises inner rotor 84, outer rotor 88, shaft 92, housing 108 and cover 112. As the shaft 92 and rotors 84 and 88 rotate, low pressure fluid is drawn into the pump through inlet connection 132 into inlet ports 120 where it enters the rotors. High pressure fluid is expelled from the rotors into discharge ports 124 and then out of the pump through discharge connection 128. This type of fixed displacement pump is well known prior art, and may include but is not limited to gerotor pumps, other types of internal gear pump, external gear pumps and crescent gear pumps. Other types of pump altogether, such as axial piston pumps and radial piston pumps may also be employed.

A speed related pressure generator 52 is mounted on shaft 92 and housed within housing 116 and cover 112. On initial start-up of the pump, fluid fills internal space 56 via priming orifice 148 which is connected to high pressure port 124 in the pump. Once internal space 56 is full, the fluid rotates substantially as a solid body with pressure generator 52, and according to the physics of a forced vortex described previously, a higher pressure exists at outer port 64 than at inner port 60. Inner port 60 is connected to inlet port 120 of the pump via passageway 76, thus the pressure at inner port 60 is effectively maintained at zero gauge pressure at all times. The pressure at outer port 64 will therefore be higher than zero gauge pressure by an amount depending on the rotational speed of the shaft 92.

Priming orifice 148 will continue to allow a small flow of fluid to enter internal space 56, which will then pass through to pump inlet ports 120 via inner port 60 and passage 76. If the orifice size is small enough, this flow will have a negligible effect on the operation of the pressure generator, and will only marginally affect the volumetric efficiency of the pump. Such orifices are currently deployed in some engine applications for the lubrication of camshaft drive chains with fine jets of oil.

A conventional relief valve plunger 96 and spring 100 are disposed within a valve bore in housing 108, and are secured in place by plug 104. The function of the valve system is to allow fluid to escape from the pump discharge back to pump inlet ports 120 via passage 144, at the condition where the net pressure forces on the valve plunger 96 are high enough to sufficiently compress spring 100.

Chamber 140 at the spring end of plunger 96 is connected to pressure from outer port 64 of pressure generator 52 via passage 44. Chamber 136 at the other end of valve plunger 96 is connected to pump discharge pressure. The net hydraulic force on valve plunger 96 thus depends on the difference between these two pressures, unlike a conventional pressure relief valve where the net hydraulic force depends on the pump discharge pressure alone.

At low speed, the pressure in chamber 140 is low and the pressure in chamber 136 creates a force on valve plunger 96 which is opposed only by the spring force. Thus the valve will open at relatively low pump discharge pressure. At high speed the pressure in chamber 140 is higher and augments the spring force. The pressure in chamber 136 must therefore also be higher in order to create the same net force required for the valve to open. Thus, the valve will open at a range of pressures according to the pump speed; the higher the speed, the higher the pressure.

As will be apparent to those of skill in the art, various known mechanisms can be employed, if desired, to alter the operation of speed-related capacity mechanism 28 such that capacity adjusting mechanism 24, or the like, is varied with the speed of drive shaft 68 or 92, rather than with the square of the speed of drive shaft 68 or 92 or proportionally to other speeds. For example, one or more orifices can be formed in disc 52, or any other body forming the containment chamber for the pressurized fluid, to allow working fluid to exit disc 52. Without such orifices, fluid 56 contained within disc 52 is unable to escape and tends to take up the same rotational speed as disc 52, each particle of fluid describing a circle, according to the accepted definition of a forced vortex. With such orifices introduced, the fluid 56 contained within disc 52 is able to flow through disc 52, thereby inducing relative motion between the fluid and the disc. The particles of fluid 56 move in outward spirals, and the effective rotational speed component of fluid 56 is reduced to less than that of disc 52, thus reducing the pressure of the working fluid at outlet ports 64. As will be apparent, the escaped working fluid can be returned via the orifices to the inlet side of the pump.

By allowing some of the working fluid to escape through such orifices, especially if the orifices are sized appropriately with respect to the viscosity of the working fluid such that a given flow will occur at given pressures, the pressure versus speed performance of pressure generator 48 can be altered to be proportional to a quantity somewhat less than the square of the rotation speed.

By employing a forced vortex of fluid, pressure generator 48 advantageously provides a mechanical means of providing a supply of pressurized fluid whose pressure is proportional to the square of a rotation speed. While in the examples above, pressure generator 48 is driven from the drive of the pump, it is contemplated that the pressure generator can be driven by any other convenient rotating member which rotates at a speed related to the speed of the pump, allowing pressure generator 48 to be located conveniently within an engine casting or elsewhere. It is also contemplated that pressure generator 48 can be employed in a variety of applications in addition to the pump capacity control applications described herein wherein a speed-related pressure is required for a control purpose and such other applications are within the contemplated scope of the present invention.

In the embodiment shown in FIG. 1, control piston 40 acts with return spring 36 against pressure control piston 32. In the embodiment shown in FIG. 5 speed related pressure acts on valve plunger 96 with return spring 100 in opposition to the pump discharge pressure. However, as will be apparent to those of skill in the art, the present invention is not so limited and merely requires that the speed related pressure be applied to a controlling member of a pump system against suitable biasing means. Such biasing means can be additional return springs, other control mechanisms and/or pistons, etc.

As described above, control pressure supply 44 is applied to a second piston, namely control piston 40, to move capacity adjusting mechanism 24. However, as will be apparent to those of skill in the art, control pressure supply 44 can instead be provided to a second chamber of a double acting piston if desired. In this manner, only a single piston, albeit a double acting one, is required.

The above-described embodiments of the invention are intended to be examples of the present invention and alterations and modifications may be effected thereto, by those of skill in the art, without departing from the scope of the invention which is defined solely by the claims appended hereto.

I claim:

1. A pump having a control mechanism for regulating an output pressure of the pump, comprising:

an inlet port;

an outlet port;

a pumping member to pump fluid from the inlet port to the outlet port;

an output adjusting mechanism to vary the output of the pump; and a pressure generator spaced apart from the pumping member and including a disc rotatable about an axis of rotation, the disc having an inlet and an outlet, both communicating with an enclosed interior volume of the disc, the inlet being radially closer to the axis of rotation than the outlet, the inlet communicating with a reservoir of working fluid and the outlet communicating with the output adjusting mechanism for operatively regulating the output pressure of the pump, wherein a pressure of the fluid supplied to the output adjusting mechanism is proportional to the rotational speed of the pressure generator.

2. A pump having a control mechanism as set forth in claim 1, wherein the disc has a plurality of circumferentially spaced inlets and a plurality of circumferentially spaced outlets.

3. A pump having a control mechanism as set forth in claim 2, wherein the disc further comprises at least one orifice to allow pressurized working fluid to escape, proportionally reducing pressure of the fluid at the outlet.

4. A pump having a control mechanism as set forth in claim 2, wherein the disc is mounted for rotation on a shaft that is common with the pump.

5. A pump having a control mechanism as set forth in claim 1, wherein the output adjusting mechanism comprises a capacity adjusting element slidably mounted for movement in response to pump output pressure and a spring biasing the capacity adjusting element to a predetermined condition, the outlet pressure cooperates with the capacity adjusting element to generate a force urging the capacity adjusting element to move towards the predetermined condition and responsively regulating output pressure of the pump.

6. A pump having a control mechanism as set forth in claim 5, wherein the capacity adjusting element cooperates with a pump housing to define an expanding chamber communicating with the output of the pump, wherein as the output of the pump increases, the capacity adjusting element moves from the predetermined condition to reduce output capacity of the pump.

7. A pump having a control mechanism as set forth in claim 5, wherein the capacity adjusting element is a ring.

8. A pump having a control mechanism as set forth in claim 1, wherein the output adjusting mechanism comprises a pressure dependent control system including a piston slidably mounted for reciprocating movement in response to pump output pressure and a spring biasing the piston to a predetermined condition, the outlet pressure cooperates with the piston to generate a force urging the piston to move towards the predetermined condition and responsively regulating output pressure of the pump.

9. A pump having a control mechanism as set forth in claim 8, wherein the piston opens and closes a passageway communicating with the pump output directing a portion of the working fluid back to the reservoir.

* * * * *